US005836858A

United States Patent [19]

Sharff

[11] Patent Number: 5,836,858

[45] Date of Patent: Nov. 17, 1998

[54] WEIGHT LIFTING APPARATUS

[76] Inventor: William A. Sharff, 1620 Sunset Circle Dr., Mt. Pora, Fla. 32757

[21] Appl. No.: 760,910

[22] Filed: Dec. 6, 1996

[51] Int. Cl.[6] ..... A63B 21/072

[52] U.S. Cl. ..... 482/106; 482/104; 482/139

[58] Field of Search ..... 482/92–94, 97, 482/98, 104, 106, 107, 108, 139, 908

[56] References Cited

U.S. PATENT DOCUMENTS

| | | | |
|---|---|---|---|
| 4,621,810 | 11/1986 | Cummings | 482/104 |
| 4,629,184 | 12/1986 | Selkee | 482/106 |
| 4,749,188 | 6/1988 | Montgomery | 482/106 |
| 4,765,612 | 8/1988 | Henry, Jr. | 482/93 |
| 4,795,149 | 1/1989 | Pearson | 482/98 |
| 4,863,159 | 9/1989 | Tassone | 482/106 |
| 4,903,962 | 2/1990 | Pollack | 482/106 |
| 5,588,942 | 12/1996 | Dillard | 482/106 |

FOREIGN PATENT DOCUMENTS

| | | | |
|---|---|---|---|
| 223926 | 6/1985 | German Dem. Rep. | 482/106 |
| 683967 | 6/1994 | Switzerland | 482/108 |
| 1818115 | 5/1993 | U.S.S.R. | 482/106 |
| 89/01805 | 3/1989 | WIPO | 482/104 |

*Primary Examiner*—Richard J. Apley
*Assistant Examiner*—Victor R. Hwang
*Attorney, Agent, or Firm*—Richard J. Johnson

[57] ABSTRACT

A safety weight lifting frame 10 comprising a generally omega shaped bar 12 having weight supporting lateral extensions 14 on the ends thereof. Lift arms 16 are pivotally connected to opposite sides of the bar for movement in generally vertical planes. Swivel couplings 23 at the upper ends of the arms removably support either separate handles 24 or a continuous bar 30. The pivoted arms lower the center of gravity of the weight frame and permit a user to exercise a muscle group through the full range of motion in a single lift.

6 Claims, 2 Drawing Sheets

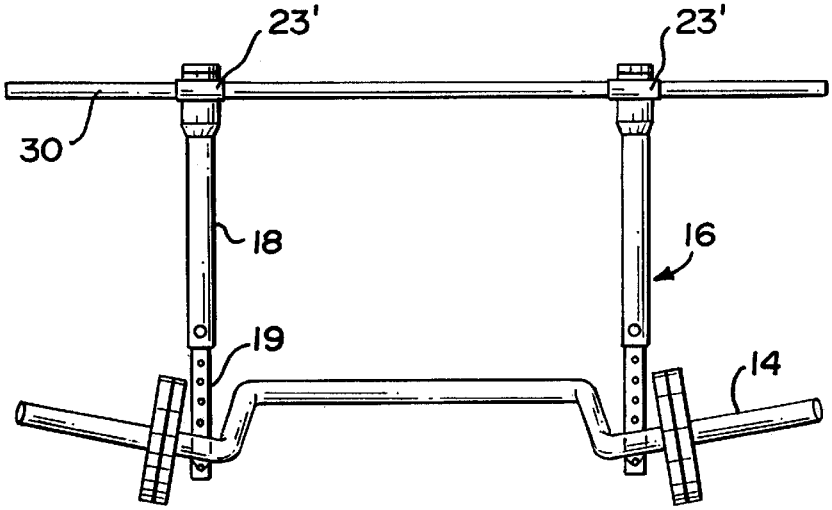
FIG. 4
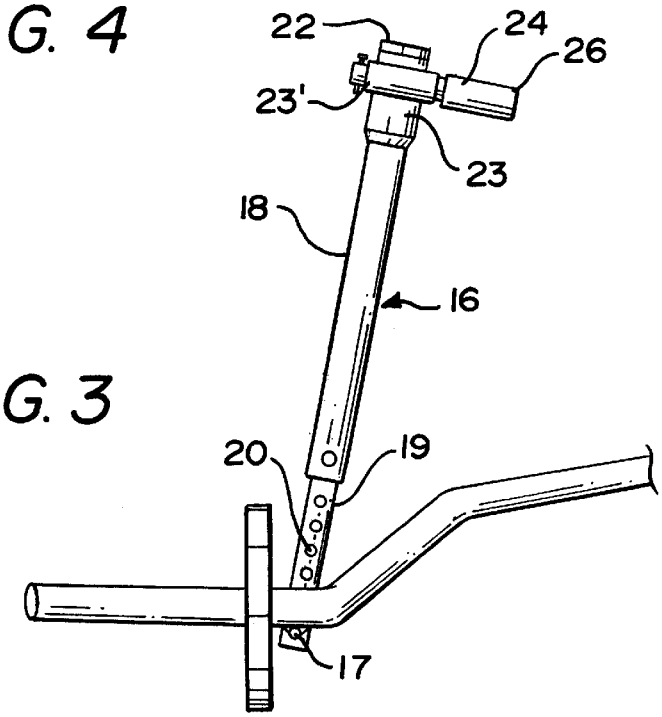
FIG. 3
FIG. 5
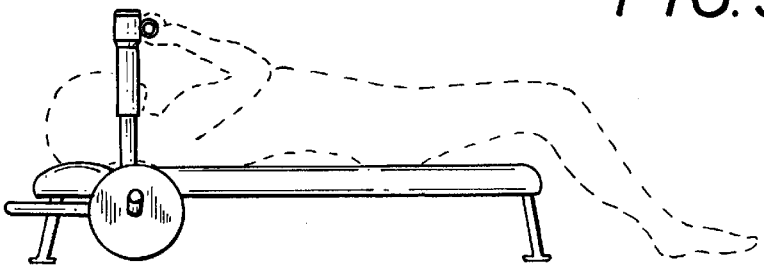

WEIGHT LIFTING APPARATUS

BACKGROUND OF THE INVENTION

This invention relates to exercising devices, and in particular to a weight lifting safety frame.

The superior results that can be achieved from exercising with so called "free weights" as compared with virtually all other strength training machines and devices are generally well known. At the same time, exercising with free weights includes a number of hazards and disadvantages. A significant number of weight lifters experience serious injuries incurred while exercising. Such result from the generally unstable nature of a raised weighted bar with its inherently high center of gravity that conventional barbell and dumbbell exercising positions require. The fall or collapse of the bar upon an individual because of tendon or ligament tears, or muscle failure while exercising to complete muscle fatigue has caused serious injuries and in a few instances death.

A deterrent for many to exercise with weights is that a full program of exercise with free weights is quite time consuming requiring lengthy periods of exercise at the expense of other pursuits. Conventional barbell and dumbbell weight lifting programs are designed to isolate and then "work" the numerous specific muscles and muscle groups of the human body. Thus, in order to exercise all of the major muscle groups of the arms, shoulders, back and chest, a large number of different exercises must be performed, each with time consuming multiple "sets" and with each set having multiple repetitions. A complete workout of all the muscle groups using free weights thus requires a significant amount of time that many individuals do not have or wish to take.

In an attempt to reduce injuries resulting from the lifting of free weights a variety of weight lifting frame devices and barbell end supports have been developed. Examples of these include U.S. Pat. Nos. 4,360,198; 2,470,815; 3,904,198; 3,290,044; 5,257,964; 5,468,203; 5,029,849; 4,799,674 and 4,890,831. To a limited extent each of these patents addresses some of the problems noted above. However, each is limited as to versatility and use and does not overcome the disadvantages described above.

It is a primary object of the invention disclosed herein to provide a compact, safe, self-spotting weight lifting frame to enable a user to obtain complete but rapid workouts with maximum muscle development at minimal risk to the weight lifter. It is a further object to provide an inexpensive weight lifting frame that will enable a user to utilize existing weight lifting equipment without the need to purchase new and expensive equipment.

Additional objects and advantages of the invention will become apparent from a reading of the description which follows.

BRIEF DESCRIPTION OF THE DRAWINGS

FIG. 3 is an enlarged view of one of the lift arms

FIG. 4 is a front view of a barbell substituted for the handles.

FIG. 5 is a side view illustrating the lift frame being used in a bench press exercise.

DETAILED DESCRIPTION OF THE INVENTION

The safety weight lifting apparatus 10 comprises a rigid generally (Ω) omega-shaped bar 12 having integral extensions 14 on each end thereof. Preferably the bar 12 is constructed from a single piece of steel formed as shown in FIG. 2 although it could be constructed from separate sections welded together.

Figure 1:
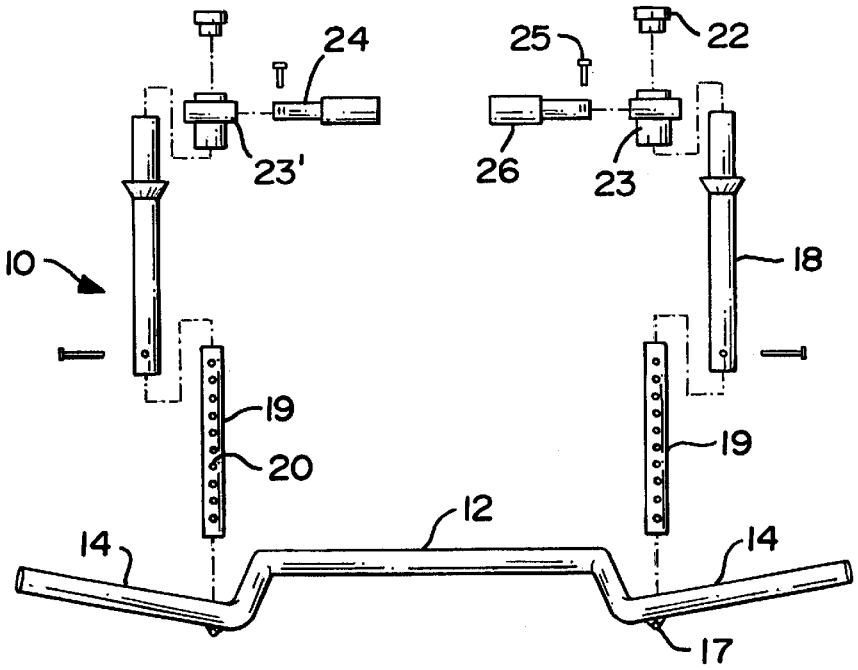
FIG. 1 is a front view of the lift frame

As illustrated in FIG. 1 the extensions 14 are outwardly angled upwardly at approximately 10 degrees for a purpose to be described subsequently.

The parts of the lift arms 16 and bar are duplicated on each lateral side of the bar centered on a central vertical bisecting plane of the U-shaped portion and are identical except for being arranged in mirror image relationship. Thus a description of one side of the lift frame should suffice for a full understanding of the invention.

Figure 2:
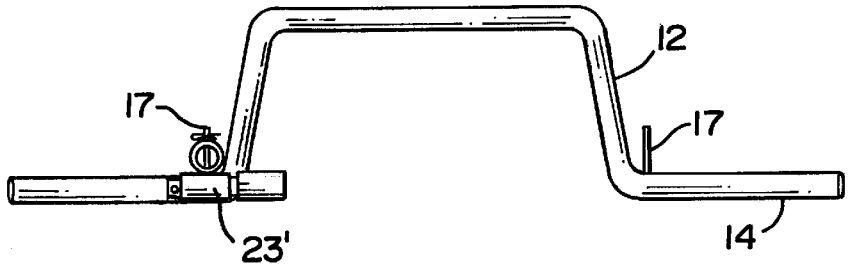
FIG. 2 is a top view of the lift frame

A lift arm 16 is pivotally connected to the bar 12 adjacent the juncture of the ends of the U-shaped portion thereof with the weight supporting extensions 14 by means of a pivot pin 17 welded to the bar and projecting forwardly thereof as illustrated in FIG. 2. Arm 16 is adjustable in length for different exercises and for users of varying height. A leg 19 having a plurality of adjustment openings 20 has its lower end pivotally secured to the pin 17 for movement in a generally transverse vertical plane. A sleeve 18 is telescoped over the leg 19 and is adjustably secured thereto in one of a plurality of extended positions by a pin 21 projecting through an opening in the sleeve 18 and a selected one of the openings 20 in leg 19. The arms 16 as illustrated have a generally centrally positioned longitudinal axis which is substantially perpendicular to a central axis of the handles 24.

The upper end of the sleeve 18 has rotatably mounted thereon a rigid double swivel T-coupling 23. Coupling 23 is rotatably secured on the sleeve 18 by means of a collar 22 fixed to the end of the sleeve 18. A similar collar would be positioned below the coupling member 23 to prevent it from sliding downwardly on the sleeve. A handle 24 may be inserted into the coupling sleeve 23' and rotatably secured by means of a push pin 25 positioned beyond the end of the coupling sleeve 23'. A suitable hand grip 26 is mounted on the opposite end of the handle 24.

As should be apparent from the above description the arms 16 are constrained to pivot in generally vertical planes about the pins 17. Because of the construction and location of the pivot connection the entire bar and attached weights can be raised and lowered with the U-shaped portion remaining in a generally horizontal position. Because of the construction of the double swivel T-coupling, the handle 24 can swivel about the axis of the sleeve 18 and arm 16 and also rotate about the axis of the coupling sleeve 23' which is generally perpendicular to the longitudinal axis of the arms 16 enabling the user to continuously conform his wrists and hands to the natural movement of the joints. In so doing the arm muscles for moving and/or holding these joints are also exercised directly and indirectly as they allow movement of the hands and arms in simulation of movements such as "flys" performed with free weights while maintaining the joints in balance.

As illustrated in FIG. 4, the handles 24 can be removed and replaced with a conventional straight barbell 30 to perform, for example, a leg and back exercise referred to as "squats." Opposite end portions of the bar 30 are inserted in a respective one of the T-coupling sleeves 23'.

In operation, the user adds the desired number of weight discs to the extensions 14. There is no significant need for separate retaining clamp means to lock the weights on the extensions because of the slight 10 degree upward angle thereof as previously described, although, such could be added if desired.

If the exercise to be performed is a bench press, for example, the separate short handles 24 will be used—rather than a single continuous bar extending across the chest of a user performing a conventional bench press. The U configured open front portion of the (Ω) omega shaped bar will fit around the end of a plain bench supporting the user. There is no need for conventional Y-shaped barbell supports attached to or positioned adjacent the bench. Even the need for a "spotter" has been eliminated since the risk to the user by a barbell has been eliminated.

Figure 6:
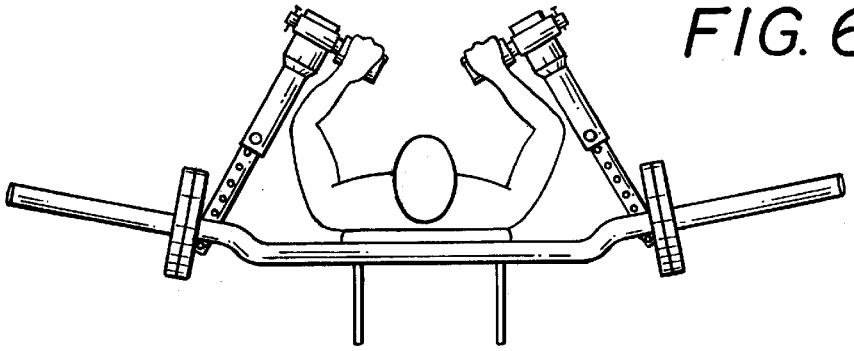
FIG. 6 is an end view illustrating the bench press exercise in a more completed movement.

As the user raises the weights off the floor (see FIG. 5) using the handles 24 the user's hands are free to rotate about the generally perpendicular axes of the sleeves 18 and 23 and are constrained to move toward each other (and the central bisecting plane) about pivot means 17. As the upper limit of vertical lifting bench press type movement approaches the lifter can move his hands toward each other (see FIG. 6) and rotate them as in a conventional fly type exercise thus continuing to isolate and work not only the triceps muscles but the entire pectoral muscle group through its full range of movement in a single motion. Such muscle exercises are accomplished only partially doing a conventional "bench press" exercise and are then completed by performing a separate exercise referred to as "flys" using "dumbbells" to fully work the pectoral muscle group. Also, natural hand, wrist and arm movements and positions can be maintained throughout each exercise because of the free pivotal movement of the handles about the plural axes.

Other exercises such as leg squats are performed using a conventional barbell 30 which is substituted for the handles 24 which are removed and replaced with the straight bar 30. With each exercise being performed advantage is taken of the unique design of the invention to permit the full range of muscle movement in each instance. It is apparent that a wide range of exercises can be performed using various combinations and arrangements of conventional weight lifting components that many users already possess.

In each instance, the exercises can be performed with a high degree of safety at all times because the center of gravity of the weighted apparatus remains relatively low in all positions of use and the apparatus is supported by the floor in positions of nonuse. Thus, even if a user loses his balance or experiences a muscle or tendon tear while performing an exercise, such as a bench press or leg squats, the weights can easily be lowered or, if necessary, dropped without causing further injury to the user.

Having described my invention I claim:

1. A safety weight lifting apparatus comprising:

a weight supporting bar having a generally U-shaped central portion and laterally, outwardly extending weight support extensions integrally secured to each end of the U-shaped portion, said U-shaped portion being located in a generally horizontal plane, pivot means secured to said bar adjacent each juncture of said U-shaped portion with said weight support extensions, a pair of elongated lift arms having upper and lower ends each pivotally connected to a respective said pivot means at a lower end thereof for movement about said pivot means only in a generally vertical plane common to both arms, each elongated lift arm including a generally centrally located longitudinally extending first axis, a swivel coupling rotatably connected to the upper end of each lift arm for rotation about said first axis, and handle means rotatably connected to each said coupling for rotation about a second axis generally perpendicular to said first axis, whereby a user may grasp said handle means and raise said U-shaped frame and weight support extensions while maintaining said U-shaped frame in a generally horizontal plane and permitting the user to concurrently move his hands and said handle means in said generally vertical plane toward each other into substantial engagement.

2. The subject matter of claim 1 wherein the bar weight support extensions angle upwardly about 10 degrees toward their respective outer ends.

3. The subject matter of claim 1 wherein the arms include means for adjusting their length thereof.

4. A safety weight lifting apparatus comprising:

a weight supporting bar having a generally U-shaped central portion terminating in laterally spaced end sections with a laterally, outwardly extending integral weight support extensions secured to each end section of the U-shaped portion, a pair of lift arms having upper and lower ends each pivotally connected at a lower end portion to the bar adjacent respective junctures of the U-shaped central portion end sections with the extensions, a swivel coupling connected to the upper end of each lift arm, and handle means connected to each said coupling, and wherein the handle means comprises a single bar extending through both swivel couplings.

5. The subject matter of claim 4 wherein said bar weight support extensions angle upwardly about 10 degrees toward their respective outer ends.

6. A weight lifting apparatus comprising:

a weight supporting bar having a generally U-shaped central portion with terminal ends and with straight laterally, outwardly extending integral extensions projecting from adjacent each terminal end of the U-shaped portion at respective junctures, said bar opposite said U-shaped portion being open and unobstructed to fit around an end portion of a user support bench, a pair of generally straight adjustable length lift arms having upper and lower ends each pivotally connected to the bar adjacent the juncture of the U-shaped central portion with the extensions, each arm constrained to pivot in a generally vertical plane while maintaining the U-shaped portion in a generally horizontal plane, a swivel coupling connected to the upper end of each lift arm, and handle means for being grasped by the hands of a user, the handle means having a central axis and connected to each said swivel coupling for pivotal movement about a first axis generally coinciding with the longitudinal axis of said arms and for rotational movement about a second axis generally coinciding with the central axis of the handle means.

* * * * *